US005966873A

United States Patent [19]

Jerg et al.

[11] Patent Number: 5,966,873

[45] Date of Patent: Oct. 19, 1999

[54] HOUSEHOLD APPLIANCE

[75] Inventors: Helmut Jerg, Giengen; Jutta Wagner, Hermaringen; Bernd Schessl, Dillingen; Dieter Hotz, Dischingen; Alfred Raab, Huttlingen, all of Germany

[73] Assignee: BSH Bosch und Siemens Hausgeraete GmbH, Munich, Germany

[21] Appl. No.: 08/821,081

[22] Filed: Mar. 20, 1997

[30] Foreign Application Priority Data

Mar. 22, 1996 [DE] Germany ..... 196 11 404

[51] Int. Cl.[6] ..... E05D 7/00

[52] U.S. Cl. ..... 49/398

[58] Field of Search ..... 49/381, 398, 399; 16/221, 385

[56] References Cited

U.S. PATENT DOCUMENTS

| | | | |
|---|---|---|---|
| 2,208,871 | 7/1940 | Rogers . | |
| 3,820,866 | 6/1974 | Kaldenberg . | |
| 4,138,988 | 2/1979 | Hurley . | |

FOREIGN PATENT DOCUMENTS

| | | | |
|---|---|---|---|
| 514011 | 9/1952 | Belgium | 49/399 |
| 566252 | 4/1958 | Belgium | 49/399 |
| 707987 | 4/1965 | Canada | 49/399 |
| 0 452 288 | 10/1991 | European Pat. Off. . | |
| 3541789 | 6/1987 | Germany . | |
| 8709496 | 10/1987 | Germany . | |
| 41 05 274 | 11/1991 | Germany . | |
| 1559081 | 4/1990 | Russian Federation | 49/398 |
| 1165739 | 10/1969 | United Kingdom . | |

*Primary Examiner*—Jerry Redman
*Attorney, Agent, or Firm*—Herbert L. Lerner; Laurence A. Greenberg

[57] ABSTRACT

In order to provide a household appliance having a door (1) which can be pivoted about a horizontal axis formed by hinges arranged on both sides of the door (1), which is composed of a shell of an outer door panel (2) and an inner door panel, in which the door (1) is effectively safeguarded against twisting in a simple manner and without using large-volume constructional units, supporting elements are arranged at least in the lower corner regions of the door (1), said elements extending between the hinge and the inner wall of at least one door panel (2, 3).

7 Claims, 1 Drawing Sheet

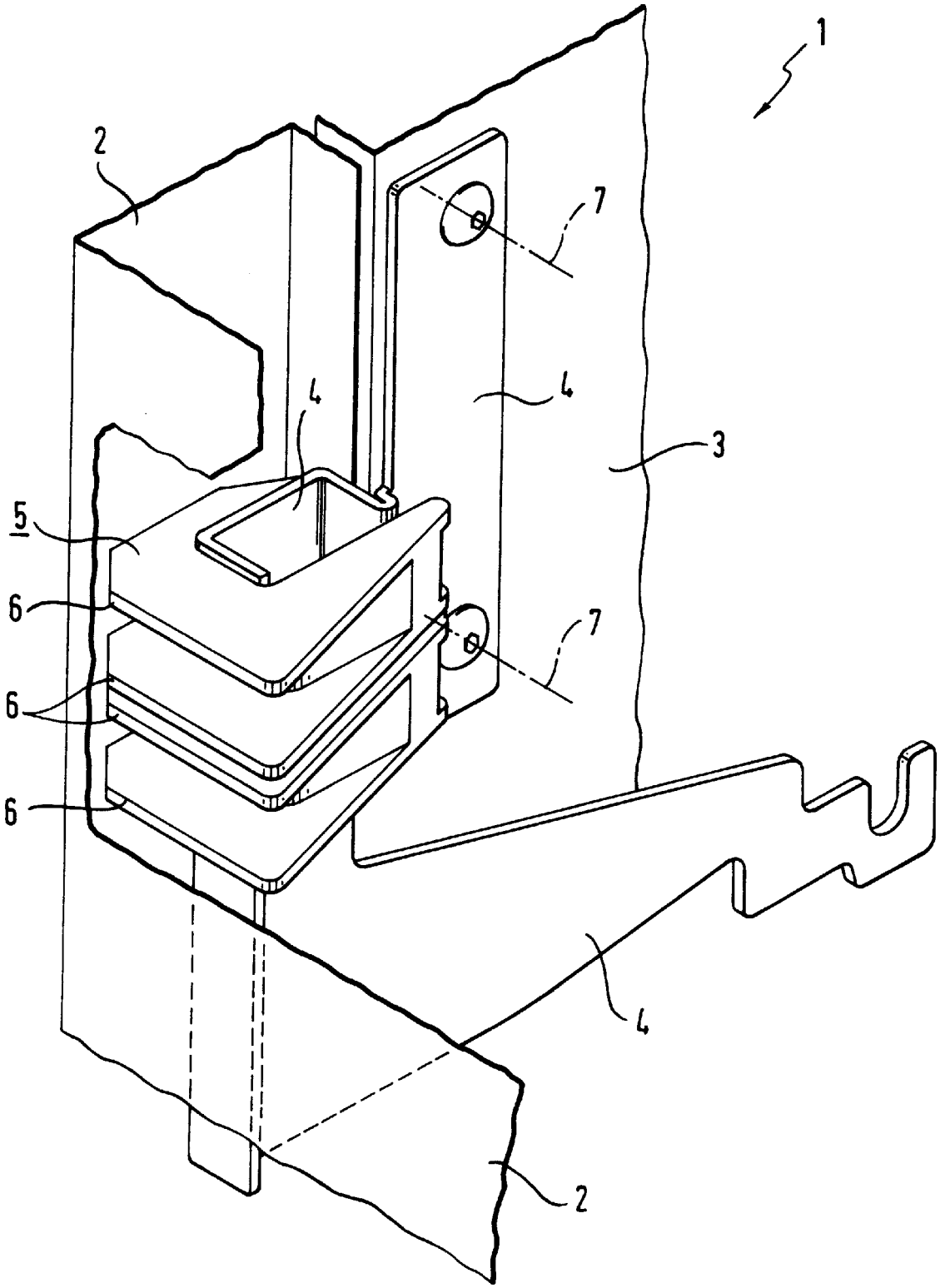
1
2
7
4
4
3
5
6
7
6
6
4
2

HOUSEHOLD APPLIANCE

BACKGROUND OF THE INVENTION

1. Field of the Invention

The invention relates to a household appliance having a door which can be pivoted about a horizontal axis formed by hinges arranged on both sides of the door, which is composed like a shell of an outer door panel and an inner door panel.

2. Description of the Related Art

Doors of this type are used, for example, in household dishwashers in order to close a treatment space, a washing container. There is normally arranged in the upper part of the door a bezel for the accommodation of the switching and indicating elements. Moreover, addition devices for additives, insulating materials, electric components, parts of a door lock and so on are usually arranged in the interspace between the two door panels. Because of the relatively large extent of a door of this type, the torsional stiffness of the door is low, which leads to difficulties in closing and sealing the door.

For this reason, various stiffening measures by means of installing stiffening elements have been proposed. Thus, for example, DE-C 35 41 789 has disclosed an L-shaped stiffening rail, which extends over the entire width of the door, forms a part of the hinge and is fastened to the parts of the door seal. Furthermore, EP-A 04 52 288 discloses a torsionally stiff element, designed as a tube, to be fastened to the hinges and extending between the latter.

The stiffening elements described above are large in volume and heavy and must be completed with the hinge, or with further parts of the hinge, before the assembly of the door, which results in a large and even heavier constructional unit, which makes its handling more difficult during production, storage and final assembly assembly of the household appliance.

SUMMARY OF THE INVENTION

The invention is therefore based on the object of providing a household appliance of the type mentioned at the beginning, in which it is made possible to safeguard the door effectively against twisting in a simple way and without using large-volume constructional units.

According to the invention, this object is achieved in that supporting means are arranged at least in the lower corner regions of the door, said means extending between the hinge and the inner wall of at least one door panel enclosing the hinge.

By means of the arrangement of supporting means in the lower corner regions of the door, constructional elements of a very low overall size are possible. Surprisingly, it has been shown in practice that the simple support between the respective hinge and one of the inner walls of the door panels enclosing it effectively prevents twisting of the door. Through the means according to the invention, in the event of an occurrence of a twisting load on one side of the door, the means rest on the side wall of the door panel enclosing the corresponding hinge and, on the other side of the door, on the front side of the door panel enclosing the corresponding hinge, as a result of which twisting cannot take place. In the region of the pivot of the door, the outer door panel is therefore prevented from being displaced in relation to the inner door panel under load, as a result of which, difficulties in closing and sealing the door are prevented. As a result of the arrangement according to the invention, a household appliance of the type mentioned at the beginning is provided in which it is made possible to safeguard the door effectively against twisting in a simple way and without using large-volume constructional units.

According to an advantageous embodiment of the invention, the supporting means between the hinge and the inner wall of at least one door panel are an extension in each case of a part of the hinge, which means a further substantial simplification of the arrangement according to the invention, since no additional part is needed.

According to a preferred embodiment of the invention, the supporting means between the hinge and the inner wall of at least one door panel are in each case a reinforcing element arranged in the lower corner regions of the door. It has been shown in practice that, because of the high forces in the event of a twisting load occurring, and in spite of the largest possible bearing surfaces, the door panels can be bent by a hinge part which rests on them as previously explained, which is prevented according to the preferred embodiment.

The reinforcing element is preferably fastened in each case to a part of the hinge, which ensures simple assembly of the reinforcing element. As a result of this mounting of this reinforcing element on a very stiff part, a displacement of the reinforcing element under twisting load is prevented, which means an additional safeguard against twisting of the door.

By definition, the reinforcing element encloses the hinge part at least at the sides on which the latter is surrounded by the door panels, which makes simpler construction of the reinforcing element possible.

Advantageously, the reinforcing element encloses the hinge part on three sides, which achieves a simplification of the assembly, and an additional retaining measure is avoided.

Expediently, the reinforcing element has a U shape, which represents a simplification in manufacture and assembly.

A further improvement in the bearing of the reinforcing element according to the invention on the inner surfaces of the door panels is achieved by the reinforcing element having circumferential bearing ribs on three sides.

The reinforcing element is advantageously fastened to the part of the hinge by means of a latching means, which represents an additional safeguard against displacement of the reinforcing element.

In a particularly advantageous manner, the reinforcing element is produced from plastic, which represents a further simplification in production and also a reduction in the weight of the arrangement, and further reduces the risk of bending the door panel when a twisting load occurs.

BRIEF DESCRIPTION OF THE DRAWING

The FIGURE is a partial perspective view of a door assembly according to the invention.

DESCRIPTION OF THE PREFERRED EMBODIMENTS

The invention is explained below using an exemplary embodiment which is illustrated in the drawing.

A household appliance according to the invention, in the exemplary embodiment a household dishwasher which is not explained in more detail, has a door 1 which can be pivoted about a horizontal axis formed by hinges arranged on both sides, which door is shown only partially in the single FIGURE and is composed like a shell of an outer door panel 2 and an inner door panel 3.

According to the invention, supporting means are arranged at least in the lower corner regions of the door 1, said means extending between the hinge and the inner wall of at least one door panel 2, 3 enclosing the hinge. The single FIGURE shows a perspective illustration of a preferred embodiment of the arrangement according to the invention, in which the supporting means between the hinge and the inner wall of at least one door panel 2, 3 enclosing the hinge are in each case a reinforcing element 5 arranged in the lower corner regions of the door 1. According to the invention, the reinforcing element 5 is supported on the inner wall of the outer door panel 2 enclosing the hinge.

The reinforcing element 5 is in each case fastened to a part of the hinge 4, said reinforcing element enclosing the hinge part 4 at least at the sides on which the latter is surrounded by the outer door panel 2. The connection of the inner door panel 3, which is connected to the outer door panel 2 in a manner which is not explained in more detail, to the hinge part 4 is carried out in the exemplary embodiment by means of screws 7, whose position in the single FIGURE is indicated in each case by a chain-dotted line. In the exemplary embodiment shown, the reinforcing element 5 surrounds the hinge part 4 on three sides and for this purpose has a U shape and is fastened to the hinge part 4 by means of a latching means, not described in more detail.

The reinforcing element 5 according to the exemplary embodiment shown is produced from plastic and has circumferential bearing ribs 6 on three sides.

The supporting means according to the invention—through the reinforcing elements 5—prevent the outer door panel 2 being displaced in relation to the inner door panel 3 under load in the region of the door 1, as a result of which the twisting of the pivot of the door 1 is prevented and difficulties in closing and sealing the door 1 are avoided.

The arrangement according to the invention provides a household appliance of the type mentioned at the beginning in which it is made possible to safeguard the door 1 effectively against twisting in a simple manner and without using large-volume constructional units.

We claim:

1. A door assembly in a household appliance, comprising:

a door in a form of a shell with an outer door panel and an inner door panel;

hinge parts supporting said door and being disposed on two lower corners of said door and being partially enclosed by said outer door panel; and reinforcing elements, respectively, disposed in said lower corners of the door, fastened to said hinge parts, enclosing said hinge parts at sides thereof on which said hinge parts are surrounded by said outer door panel, extending between said hinge parts and an inner wall of said outer door panel and bearing against said inner wall of said outer door panel.

2. The assembly according to claim 1, wherein said reinforcing elements, respectively, form extensions of said hinge parts.

3. The assembly according to claim 1, wherein said reinforcing elements, respectively, enclose said hinge parts on three sides thereof.

4. The assembly according to claim 1, wherein said reinforcing elements are U-shaped elements.

5. The assembly according to claim 1, wherein said reinforcing elements are formed with circumferential bearing ribs on three sides thereof.

6. The assembly according to claim 1, which further comprises latches fastening said reinforcing elements to said hinge parts.

7. The assembly according to claim 1, wherein said reinforcing elements are formed of plastic.

* * * * *